US008460128B2

(12) United States Patent
Elpers

(10) Patent No.: US 8,460,128 B2
(45) Date of Patent: Jun. 11, 2013

(54) MULTI SPORTS NET WITH REBOUNDER

(75) Inventor: Philip Elpers, Evansville, IN (US)

(73) Assignee: Indian Industries, Inc., Evansville, IN (US)

( * ) Notice: Subject to any disclaimer, the term of this patent is extended or adjusted under 35 U.S.C. 154(b) by 260 days.

(21) Appl. No.: 12/974,317

(22) Filed: Dec. 21, 2010

(65) Prior Publication Data

US 2012/0157239 A1 Jun. 21, 2012

(51) Int. Cl.

*A63B 69/00* (2006.01)
*A63B 63/00* (2006.01)
*A63B 69/40* (2006.01)

(52) U.S. Cl.

USPC ..... 473/431; 473/422; 473/435

(58) Field of Classification Search

USPC ..... 473/421, 422, 197, 195, 434, 435, 473/470–471; D21/699, 780; 273/396, 407, 273/410

See application file for complete search history.

(56) References Cited

U.S. PATENT DOCUMENTS 1,262,314 A * 4/1918 Downey ..... 473/158
1,545,772 A * 7/1925 Jacobs ..... 473/190
1,629,907 A * 5/1927 Dwyer ..... 473/197
2,923,547 A 2/1960 Heeremans
3,339,925 A * 9/1967 Nissen ..... 473/469
4,083,561 A 4/1978 Daffer, Jr.
4,286,786 A 9/1981 Papadopoulos
4,417,728 A * 11/1983 Hay et al. ..... 473/435
4,457,513 A * 7/1984 Thompson ..... 473/469
4,650,189 A 3/1987 Rajacich
4,932,657 A 6/1990 Hailer et al.
5,205,564 A * 4/1993 Lamberti et al. ..... 473/421
5,249,796 A 10/1993 Silvi
5,431,411 A 7/1995 Padilla
5,549,304 A * 8/1996 Davis ..... 273/396
5,558,338 A 9/1996 Taub
5,672,125 A * 9/1997 Ross ..... 473/421
5,967,911 A 10/1999 McAvoy
6,155,936 A * 12/2000 Dorr ..... 473/456
6,319,145 B1 * 11/2001 Coughlan ..... 473/197
6,878,078 B2 4/2005 Swanson
6,929,569 B1 8/2005 Wang
7,244,199 B1 7/2007 Romano
7,351,168 B1 4/2008 Pannell
7,530,909 B2 5/2009 Thomas et al.
7,549,433 B2 * 6/2009 Zheng ..... 473/471
7,704,169 B1 * 4/2010 Bove et al. ..... 473/426
2003/0125121 A1 * 7/2003 Rhee ..... 473/195
2005/0189719 A1 9/2005 Goldwitz
2008/0067751 A1 * 3/2008 Hunt ..... 273/396
2012/0129633 A1 * 5/2012 Chen ..... 473/435

* cited by examiner

*Primary Examiner* — Mitra Aryanpour
(74) *Attorney, Agent, or Firm* — Woodard, Emhardt, Moriarty, McNett & Henry LLP

(57) ABSTRACT

A ball sports practice device is disclosed having a forward facing ball capture enclosure and a rear facing rebound structure. The angle between the ball capture enclosure and the rebound structure may be adjusted to support the device to a plurality of use positions on a support surface. An optional support arm may be included to maintain or limit the angle between the capture enclosure and the rebound structure.

20 Claims, 9 Drawing Sheets

MULTI SPORTS NET WITH REBOUNDER

FIELD OF THE INVENTION

The present invention relates to sports goals and ball return devices for sports and, more particularly, to a combination multi-sports net and rebounder.

BACKGROUND OF THE INVENTION

Various types of netted enclosures for use as sports goals or capture devices are known in the art. Such devices typically include a loose fitting net which is draped about a frame to create an enclosure which is open to the front. Balls are directed into the enclosure during game play or practice drills. Other devices for rebounding balls are also known in the art. These devices typically include an elastic net which is stretched taut about a frame, creating a rebound or "pitch-back" effect when balls are directed into the net.

An improved system which functions as both a ball capture device and a rebounder is desired.

SUMMARY OF THE INVENTION

According to one aspect, the present disclosure includes a ball sports practice device comprising a forward facing ball capture enclosure and a rear facing ball rebound structure. The capture enclosure comprises a first frame having a substantially rectangular front opening to an interior capture area. The interior capture area is defined by a substantially vertical rear capture surface and two vertical side capture surfaces extending outward on opposing sides of said rear capture surface. The rebound structure is arranged on the device on the side opposite the capture area of said first frame and comprises a second frame attached to the first frame and a rebound net stretched across the second frame. The capture enclosure and the rebound structure define an angle between them which may be adjusted to support the device at a plurality of use positions on a support surface.

Preferably the ball sports practice device can be used as a soccer or other ball sport goal or as a ball rebound device.

It is an object of the invention to provide an improved sports ball capture and rebound device.

Further objects, features and advantages of the present invention shall become apparent from the detailed drawings and descriptions provided herein.

DESCRIPTION OF PREFERRED EMBODIMENTS

Figure 1:
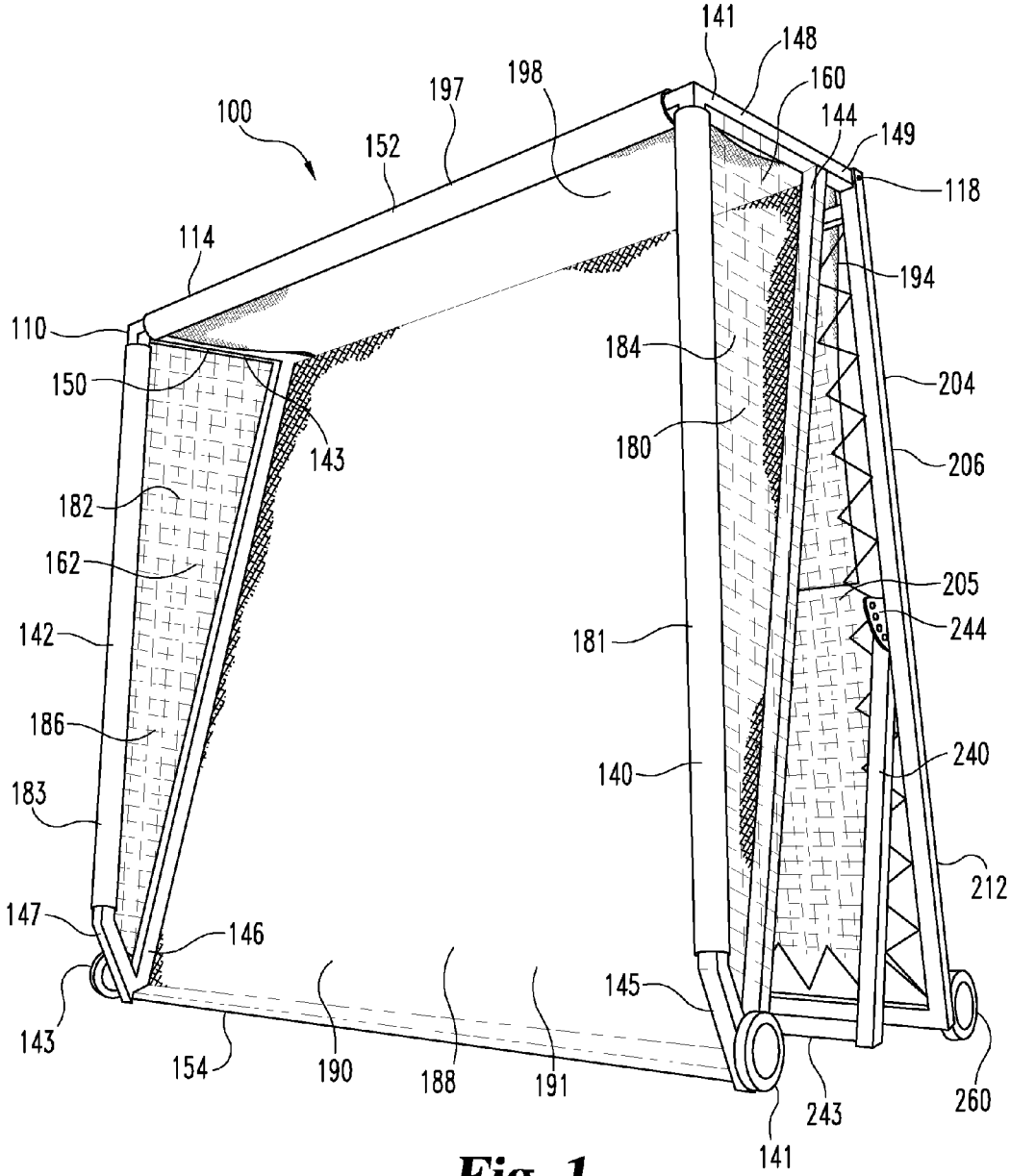
FIG. 1. is a front right-side perspective view of an embodiment of the present invention.

For the purposes of promoting an understanding of the principles of the disclosure, reference will now be made to the embodiments illustrated and specific language will be used to describe the same. It will nevertheless be understood that no limitation of the scope of the invention is thereby intended, such alterations, modifications, and further applications of the principles being contemplated as would normally occur to one skilled in the art to which the invention relates.

FIGS. 1-9 depict an example embodiment of a ball sports practice device, denoted generally by the numeral 100, comprising a front ball capture enclosure 110 and a rear rebound structure 204. The enclosure 110 and rebound structure 204 are supported by a front frame 114 and a rear frame 206, respectively. The front frame 114 and rear frame 206 are adjustable, for example via a pivotal connection using upper hinges 118 and 120. The hinges 118 and 120 allow the angle θ between the axis 211 of rebound structure 204 and axis 213 of enclosure 110 (see FIG. 6) to be adjusted.

In some embodiments, support arms 240 and 242 extend downward from the approximate vertical midpoints of sidemembers 212 and 214 of the rear frame 206 as shown. Adjustable locking hinges 244 and 246 connect the support arms 240 and 242 to the sidemembers 212 and 214. The angle of the support arms 240 and 242 maintains or limits the angle θ when the device 100 is in a use position as shown in FIGS. 1-6. The front and rear frames 114 and 206 may be constructed from metal, plastic, composite, or any other suitably rigid material.

The term "surface" as used herein with respect to components of the device 100 shall be understood to mean any continuous or non-continuous boundary material, including, but not limited to, fabric, mesh, netting, chain link, or the like. It shall be understood that the terms "front," "forward," and "rear" as used herein are for convenient reference only and do not define an overall placement or orientation of the device 100 with respect to a user.

Figure 2:
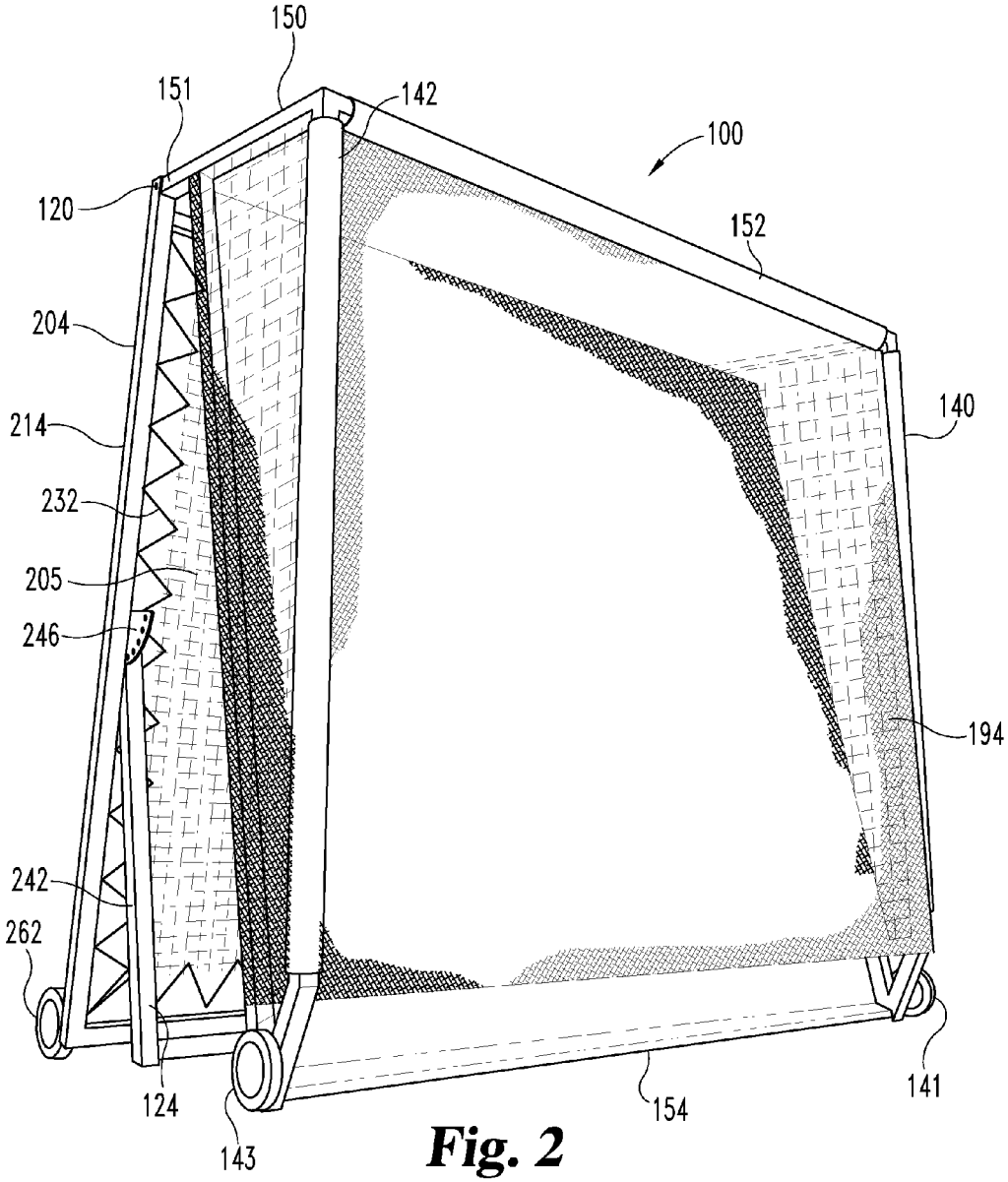
FIG. 2 is a front left-side perspective view of the embodiment of FIG. 1.

As shown in FIGS. 1 and 2, the front frame 114 includes sidemembers 140, 142, 144, 146, 148 and 150. Sidemembers 140 and 142 are generally vertical and orthogonally connected to the front ends 141 and 143 of horizontal sidemembers 148 and 150, respectively. Sidemember 144 is connected at an angle between sidemembers 140 and 148 as shown, thereby creating a generally triangular side area 160. Likewise, sidemember 146 is connected at an angle between sidemembers 142 and 150 as shown, to create a generally triangular side area 162. Upper and lower horizontal crossmembers 152 and 154 are orthogonally connected between the upper and lower ends of sidemembers 140 and 142, respectively, as shown. The individual members 140, 142, 144, 146, 148 and 150 may be permanently attached together (e.g., by welding or forming as a unitary piece) or attached together using appropriate fasteners for easier packaging and storage.

Netted portions 180 and 182 are wrapped around the generally triangular side areas 160 and 162, respectively to create side capture surfaces 184 and 186 respectively. In addition, fabric portion 188 extends between the sidemembers 144 and 146 to create a rear capture surface 190. Together, the capture surfaces 184, 186 and 190 define an interior capture area 191. In a preferred embodiment, the side capture surfaces 184 and 186 comprise an open net material and the rear capture surface 190 comprises a heavier tarp material which is loosely fitted to allow captured balls to drop down instead of forcefully rebounding. However, the capture surfaces 184, 186 and 190 may also be constructed of other materials including netting, fabric, plastic, wood, metal and the like. As the incoming balls drop down after striking the rear capture surface 190, they will be directed outward toward the user due to the downward and outward angle of the rear capture surface 190 and the sidemembers 144 and 146.

In certain embodiments, the capture side capture surfaces 184 and 186 and rear capture surface 190 are sewn or otherwise attached together as a single unit. This allows the front edges of the side capture surfaces 184 and 186 to be attached to the sidemembers 140 and 142, respectively, thereby eliminating the need to attach the rear capture surface 190 directly to the sidemembers 144 and 146. In other embodiments, the capture surfaces 184, 186 and 190 may be provided as separate pieces and attached to the front frame 114 individually.

The side capture surfaces 184 and 186 are preferably attached to the sidemembers 140 and 142 using sleeves 181 and 183. In one embodiment, the sleeves 181 and 183 include hook-and-loop fasteners, buttons, ties, or other appropriate securing devices which enable the sleeves 181 and 183 to be wrapped around the sidemembers 140 and 142 and secured as shown. In other embodiments, where the sidemembers 140 and 142 are separable from the front frame 114, the sleeves 181 and 183 may be slid onto the sidemembers 140 and 142 prior to installation.

Figure 6:
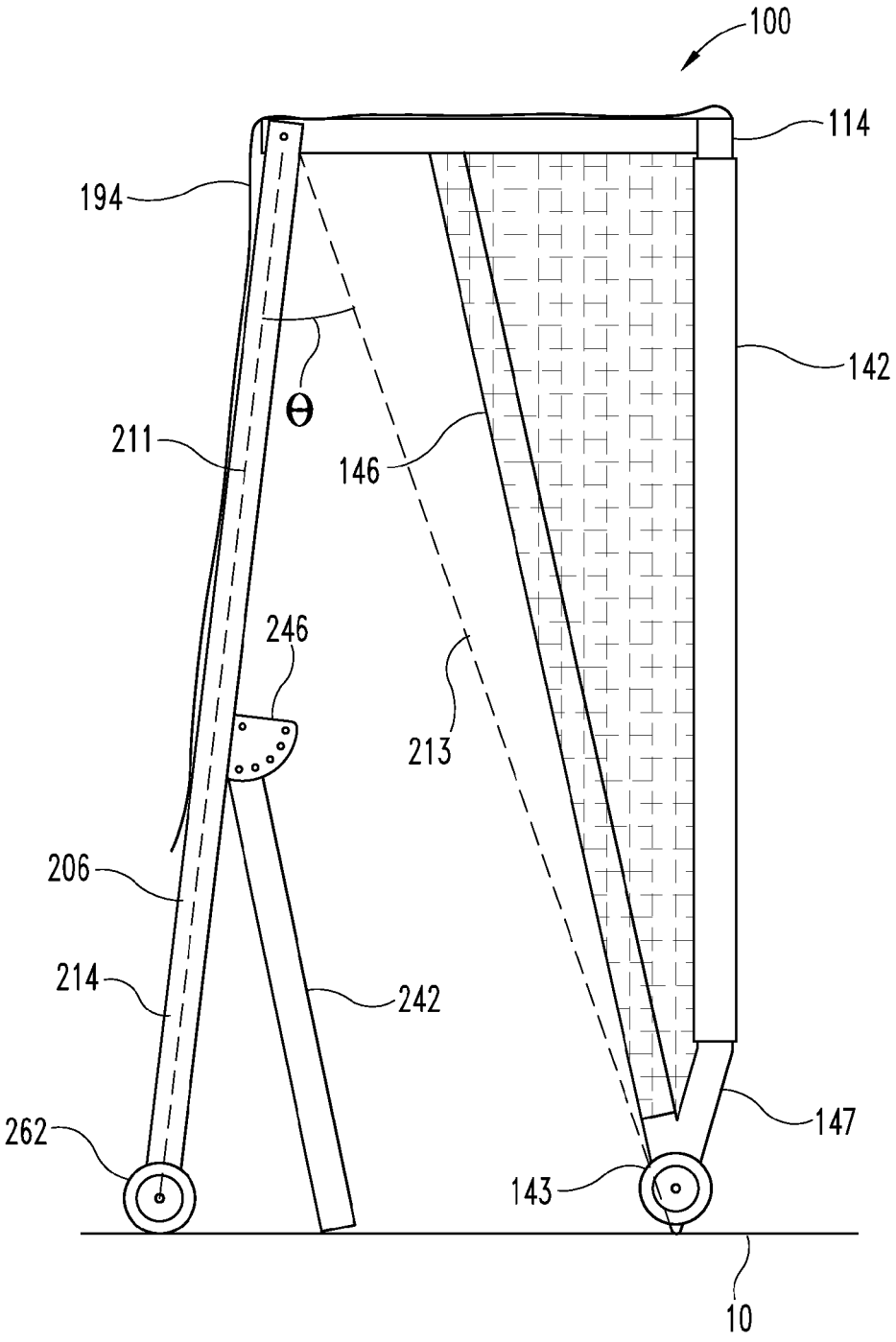
FIG. 6 is a side view of the embodiment of FIG. 1 in an upright position.

A slack curtain 194 may be optionally included to further dampen the force of incoming balls as they enter the capture area 110. The slack curtain 194 is preferably attached to the upper cross member 152 using sleeve 197 and hangs freely as shown FIG. 2. When not in use, the slack curtain 194 may be lifted up and laid over the top of rebound structure 204 as shown in FIGS. 1 and 6. This also has the effect of creating a top capture surface 198 to assist in capturing incoming balls. The slack curtain 194 is preferably constructed from a heavy fabric or tarp material to increase the damping effect, although other lighter or heavier materials may be utilized depending on the degree of damping desired. It shall be understood that the slack curtain 194 may be constructed as a continuous piece or as a mesh or net.

Figure 3:
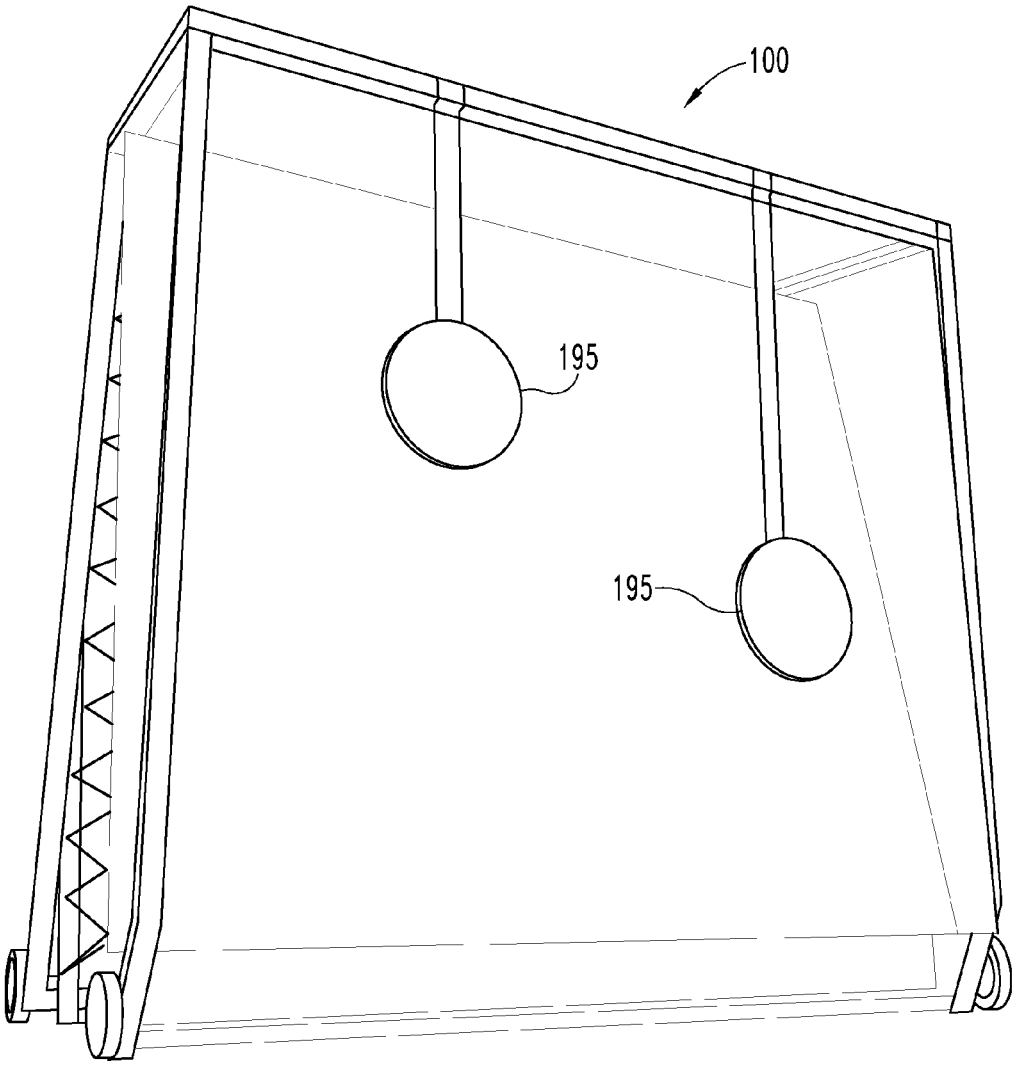
FIG. 3 is a front left-side perspective view of the embodiment of FIG. 1 with targets.

As shown in FIG. 3, one or more targets 195 may be optionally included to provide further guidance for the user when kicking or throwing balls into the capture enclosure 110. In one embodiment, the targets 195 are suspended from the upper crossmember 152. In other embodiments, the targets 195 may be attached to the slack curtain 194 or to the rear capture surface 190.

Figure 4:
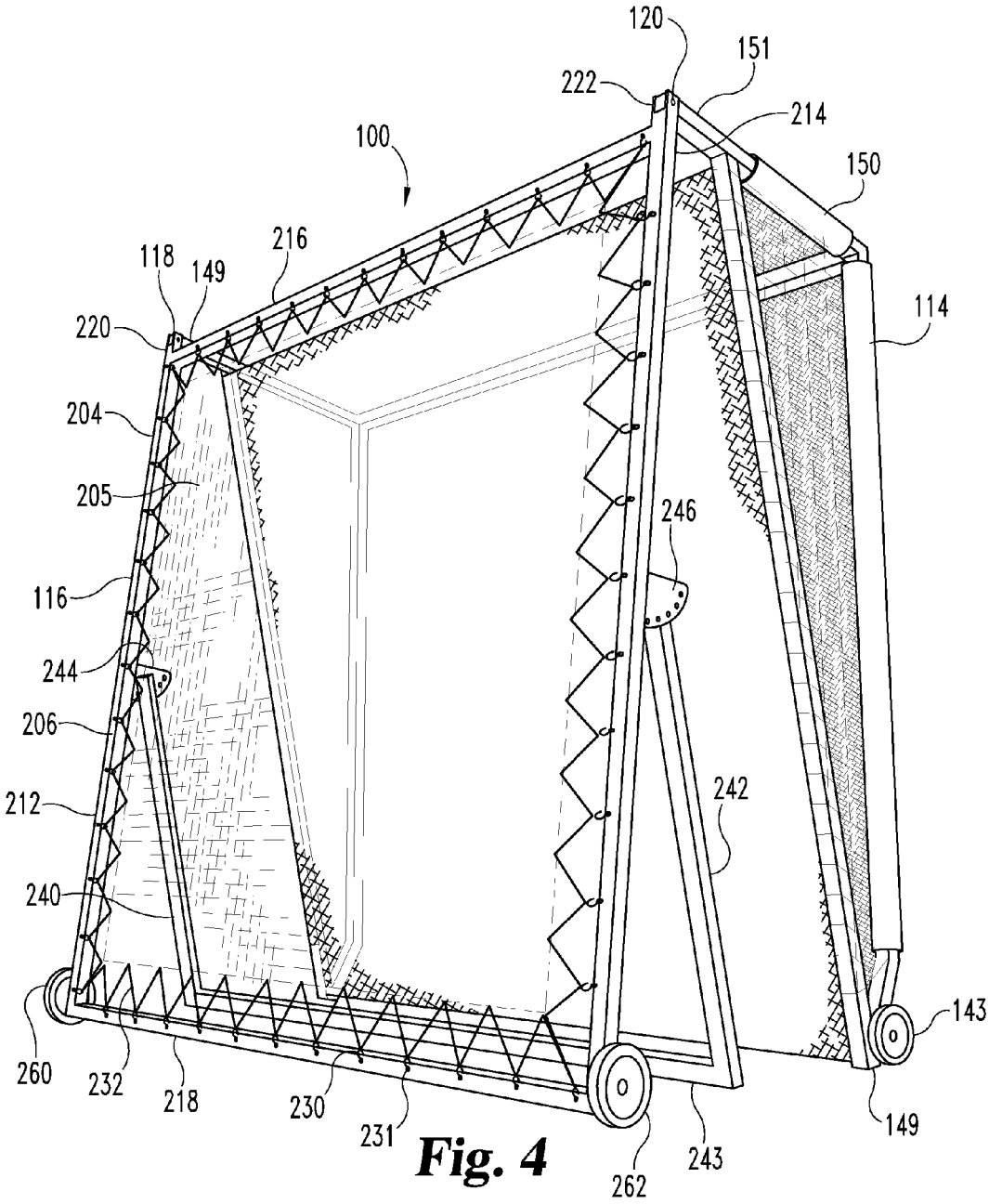
FIG. 4 is a rear perspective view of the embodiment of FIG. 1 in an upright position.

As shown in FIG. 4, the rebound structure 204 comprises a rebound surface 205 stretched about the rear frame 206. The rebound surface 205 preferably comprises netting, although other types of materials may be used, such as woven fabric. Rear frame 206 comprises sidemembers 212 and 214, and upper and lower crossmembers 216 and 218. The upper ends 220 and 222 of sidemembers 212 and 214 are connected to the rear ends 149 and 151 of sidemembers 148 and 150 by hinges 118 and 120 respectively.

The rebound surface 205 is preferably attached to rear frame 206 using hooks 230 inserted into holes 231. The rebound surface 205 is sized such that when attached to the frame 206, it will become rigid or taut to create a forceful rebound effect on incoming balls. In the illustrated embodiment, elastic cording 232 is woven taut between the outer edges of the rebound surface 205 and the hooks 230 as shown to increase the rebound effect.

As mentioned above, support arms 240 and 242 extend downward from the approximate vertical midpoints of sidemembers 212 and 214, respectively, with lower crossmember 243 connecting the support arms 240 and 242 for stability as shown. In a preferred embodiment, hinges 244 and 246 connect the support arms 240 and 242 to the sidemembers 212 and 214. The hinges 244 and 246 may also be configured to lock at one more selected angles, for example using locking pins. It shall be understood that other types of adjustable locking hinges or angle locking mechanisms may also be used to adjust, maintain or limit the angle of support arms 240 and 242 relative to rear frame 206.

Figure 5:
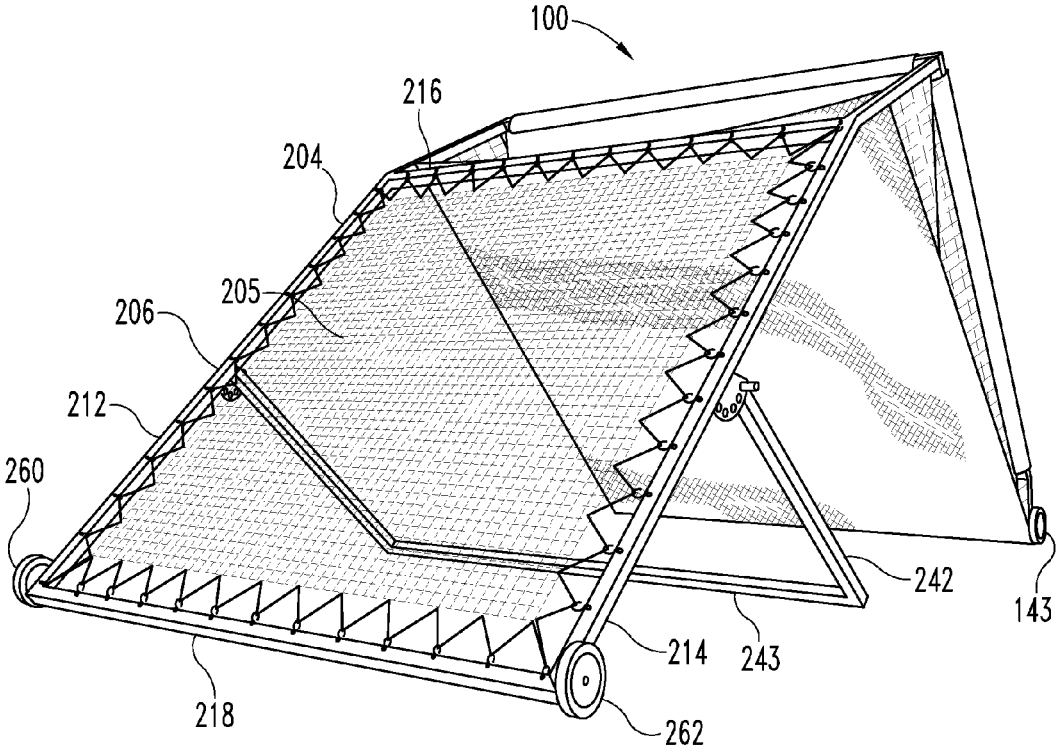
FIG. 5 is a rear perspective view of the embodiment of FIG. 1 in a lowered position.

Wheels 260 and 262 are preferably attached to the lower ends of the sidemembers 212 and 214 to allow the bottom of the rear frame 206 to move freely as the angle of the rebound structure 204 is transitioned between use positions, for example from an upright use position (as shown in FIG. 4) to a more horizontal use position (as shown in FIG. 5) and vice versa. Due to the action of hinges 118 and 120, gravitational force will tend to spread the bottom of rear frame 206 and the bottom of front frame 114 laterally further apart (thereby increasing the angle θ between axis 213 and axis 211 as shown in FIG. 6). The support arms 240 and 242, when angularly fixed relative to the rear frame 214, will only allow the spreading to occur until a point at which the bottom of the support arms 240 and 242 make contact with the support surface 10, such as the ground or floor.

It shall be understood that other mechanisms may be used to control or limit the spreading action. For example, instead of contacting the ground, the lower ends of the support arms 240 and 242 may be attached directly to the sidemembers 140 and 142, respectively. In other embodiments, adjustable chains, straps, or bars may be connected between the front frame 114 and the rear frame 206.

Figure 7:
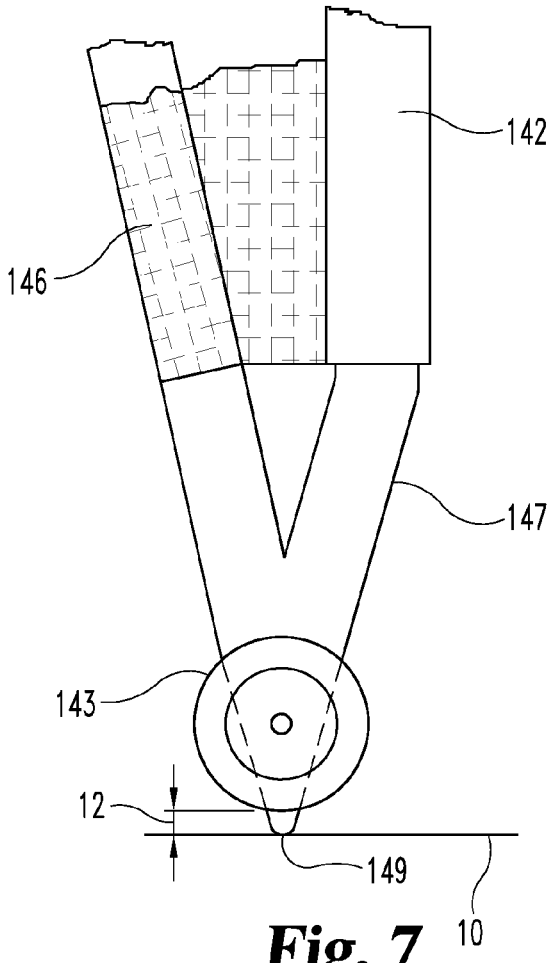
FIG. 7 is an enlarged view of the front wheel portion of the embodiment of FIG. 1 in the upright position.

Wheels 141 and 143 may be optionally provided near the lower ends of the sidemembers 140 and 142 of the front frame 114. However, unlike wheels 260 and 262, wheels 141 and 143 are preferably positioned such that there is a vertical gap 12 (as shown in FIGS. 6 and 7) between the bottom edge 149 of the front frame 114 and the wheels 141 and 143 when the device 100 is in a use position. Therefore, the bottom edge 149 of the front frame 114 will be in contact with the support surface 10 to provide stability and help prevent the device 100 from laterally sliding during use. When installed on a natural grass or dirt support surface, the lower edge 149 may sink slightly into the support surface 10, allowing the wheels 141 and 143 to contact the support surface 10, however the bottom edge 149 of the front frame 114 will still provide stability and prevent the wheels 141 and 143 from rolling.

Figure 8:
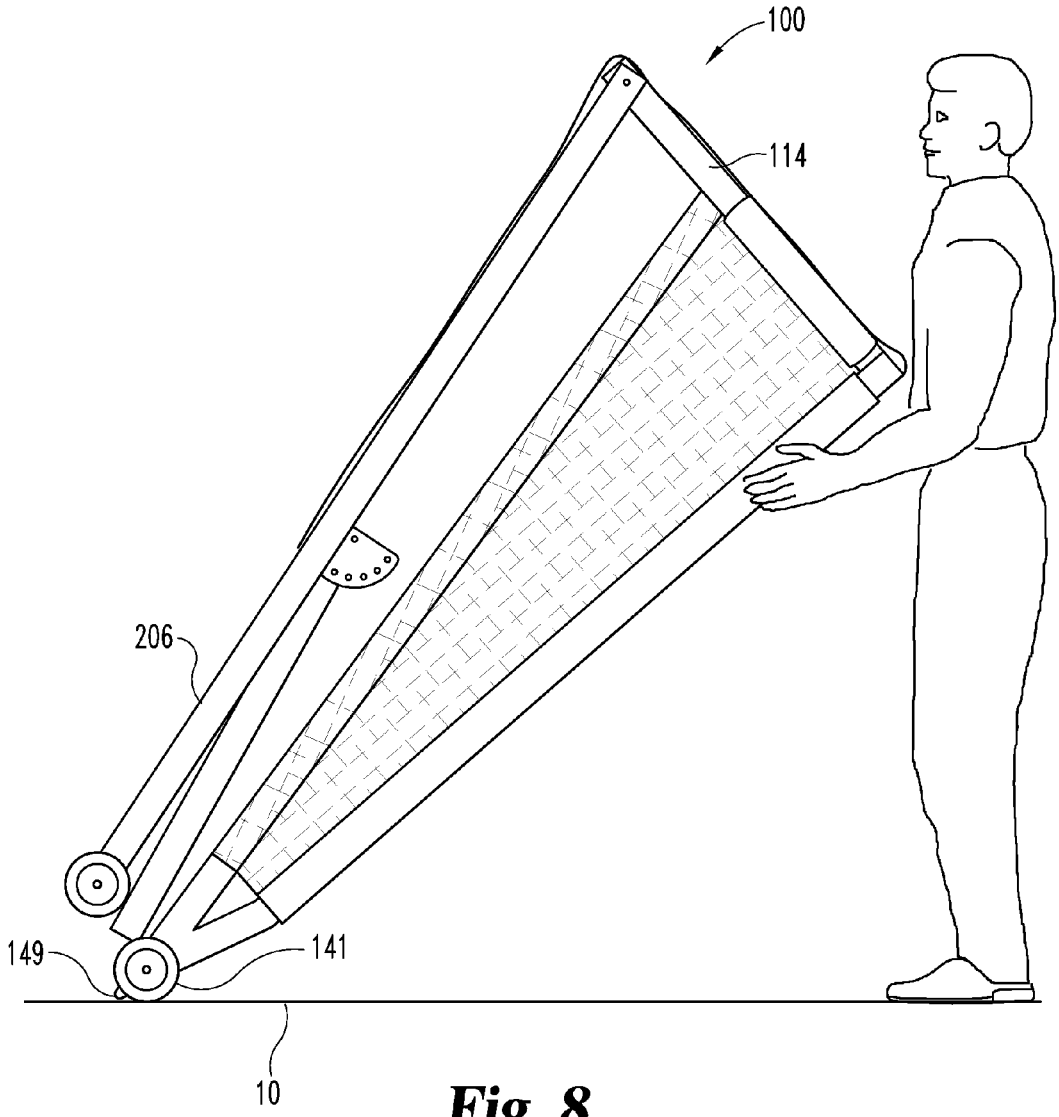
FIG. 8 is a side view of the embodiment of FIG. 1 in the transport position.
Figure 9:
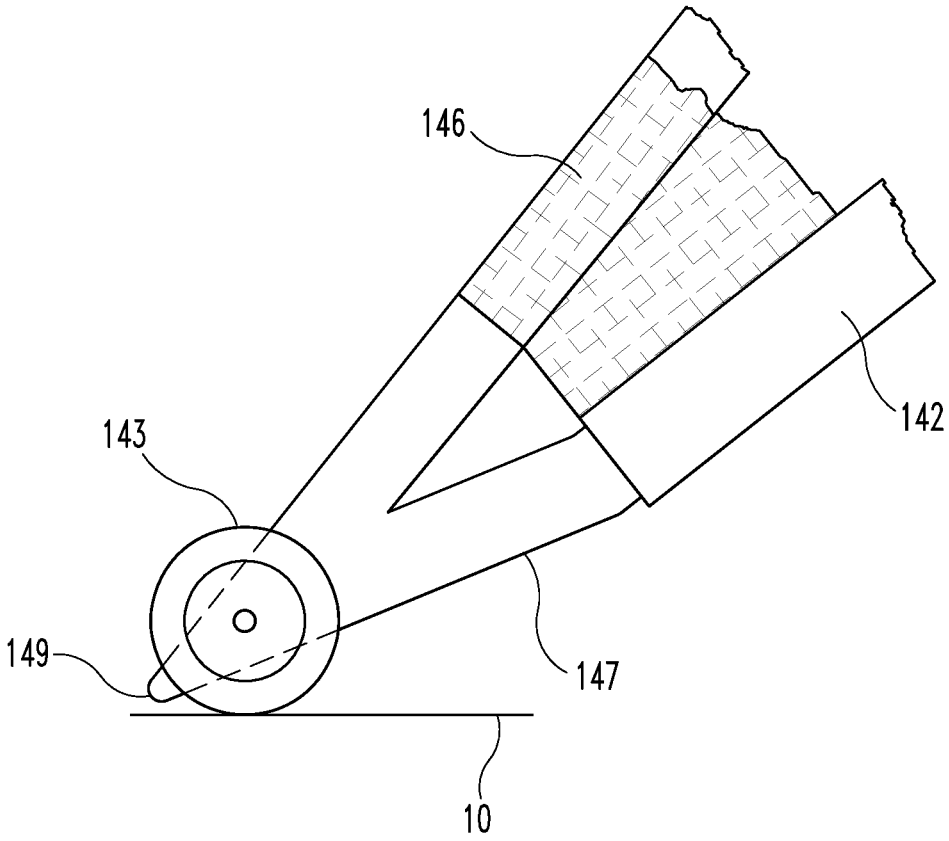
FIG. 9 is an enlarged view of the front wheel portion of the embodiment of FIG. 1 in the transport position.

To transport the device 100, the user pulls forward on the upper portion of the front frame 114 until the wheels 141 and 143 make contact with the support surface 10 as shown in FIG. 8. As the front frame 114 tilts forward, the rear frame 206 will collapse into the front frame 114, further reducing the amount of force required for the user to tilt the device 100 into the transport position. Due to the location of the wheels 141 and 143 relative to the lower edge 149 of the front frame 114, the lower edge 149 will raise off the ground 10 as wheels 141 and 143 make contact with the support surface 10 as shown in FIG. 8. Once supported by the wheels 141 and 143, the device 100 can be safely rolled along the support surface 10 for transport.

In certain embodiments, the lower end of the sidemembers 140 and 142 may include knee portions 145 and 147 which are angled downward and rearward from the sidemembers 140 and connect to the bottom ends of the sidemembers 144 and 146 as shown. The angle of the knee portions provides clearance and allows the wheels 141 and 143 to be raised above the support surface when the device 100 is in use. Yet the knee portions provide the effect of decreasing the degree to which the user must tilt the front frame 114 in order for the wheels 141 and 143 to be lowered into contact with the support surface 10 for transport. The use of the knee portions 145 and 147 also allows for the lower portions of the side capture surfaces 184 and 186 to be increased, providing a more effective capture effect for balls directed to the lower portions of the enclosure 110.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A ball sports practice device, comprising:

a forward facing ball capture enclosure, said enclosure comprising:

a first frame having a substantially rectangular front opening to an interior capture area, said interior capture area defined by a substantially vertical rear capture surface and two vertical side capture surfaces extending forward from opposing ends of said rear capture surface; and a rear facing ball rebound structure arranged on the device on the side opposite the capture area of said first frame, said rebound structure comprising:

a second frame attached to said first frame; and a rebound net stretched across said second frame;

wherein an angle is generally defined between the capture enclosure and the rebound structure, and wherein the angle may be adjusted to support the device at a plurality of use positions on a support surface by changing the lateral distance between a lower end of the first frame and a lower end of the second frame.

2. The ball sports practice device of claim 1, wherein an upper portion of the ball capture enclosure is pivotally attached to an upper portion of the rebound structure along a horizontal axis.

3. The ball sports practice device of claim 2, comprising:

a support arm for maintaining the relative angle between said capture enclosure and said rebound structure in a selected one of said use positions, said support arm attached to at least one of said first frame and said second frame.

4. The ball sports practice device of claim 3, wherein said support arm is attached to said second frame.

5. The ball sports practice device of claim 4, wherein an upper end of said support arm is pivotally attached to said second frame by a hinge which can be locked in selected positions, and wherein a lower end of said support arm makes contact with a support surface at a point between the first frame and the second frame.

6. The ball sports practice device of claim 1, comprising:

a first and second wheel attached to a lower portion of said first frame;

wherein said first and second wheels are positioned such that a vertically lowest point of said first and second wheels is above a vertically-lowest edge of the first frame which engages the support surface when the device is in one of said use positions; and wherein the device may be tilted into a transport position, such that said vertically lowest point of said first and second wheels is moved below the vertically-lowest edge of the first frame to engage the support surface.

7. The ball sports practice device of claim 6, comprising:

a third and fourth wheel attached to a lower portion of said second frame, said third and fourth wheels positioned to allow the lower portion of said second frame to move laterally as said relative angle between said capture enclosure and said rebound structure is adjusted to one of said plurality of use positions or to said transport position.

8. The ball sports practice device of claim 1, wherein said rear capture surface of said ball capture enclosure includes a portion angled downward and forward in one of said use positions to return captured balls toward a user.

9. The ball sports practice device of claim 6, wherein said first frame comprises sidemembers, said sidemembers defining lower knee portions which are angled toward said first and second wheels to provide clearance between said first frame and the support surface when the device is in the transport position.

10. The ball sports practice device of claim 1, wherein said rear capture surface comprises a loose fitting material.

11. The ball sports practice device of claim 1, comprising a slack curtain which hangs freely from an upper crossmember of said first frame.

12. The ball sports practice device of claim 11, wherein the slack curtain may be draped over the top of the rebound structure to define a top ball capture surface for said interior capture area.

13. The ball sports practice device of claim 1, comprising at least one target mounted to said capture enclosure which indicates a desired target area within the ball capture enclosure.

14. A ball sports practice device, comprising:

a forward facing ball capture enclosure, said enclosure comprising:

a first frame having a substantially rectangular front opening to an interior capture area, said interior capture area defined by a substantially vertical rear capture surface and two vertical side capture surfaces extending forward from opposing ends and substantially perpendicular to said rear capture surface; and a rear facing ball rebound structure arranged on the device on the side opposite the capture area of said first frame, said rebound structure comprising:

a substantially rectangular second frame, an upper portion of the second frame pivotally attached to an upper portion of said first frame along a horizontal axis; and a rebound net stretched across said second frame;

wherein the relative angle between the capture enclosure and the rebound structure may be adjusted to support the device at a plurality of use positions on a support surface.

15. The ball sports practice device of claim 14, comprising:

a control mechanism to maintain the relative angle between said capture enclosure and said rebound structure in a selected one of said use positions.

16. The ball sports practice device of claim 15, wherein a support arm has an upper end pivotally attached to said second frame by a hinge which can be locked in selected positions, and wherein a lower end of said support arm makes contact with a ground surface at a point between the first frame and the second frame.

17. The ball sports practice device of claim 14, comprising:

a first and second wheel attached to a lower portion of said first frame;

wherein said first and second wheels are positioned such that a vertically lowest point of said first and second wheels is above a vertically-lowest edge of the first frame which engages the support surface when the device is in one of said use positions; and wherein the device may be tilted into a transport position, such that said vertically lowest point of said first and second wheels is moved below the vertically-lowest edge of the first frame to engage the support surface.

18. The ball sports practice device of claim 14, wherein said rear capture surface of said ball capture enclosure includes a portion angled downward and forward in at least one of said use positions to return captured balls toward a user.

19. The ball sports practice device of claim 17, wherein said first frame further comprises sidemembers, said sidemembers defining lower knee portions which are angled toward said first and second wheels to provide clearance between said first frame and the support surface when the device is in the transport position.

20. The ball sports practice device of claim 14, comprising a slack curtain which hangs freely from an upper crossmember of said first frame.

* * * * *